US007167673B2

(12) United States Patent
Cahill et al.

(10) Patent No.: US 7,167,673 B2
(45) Date of Patent: Jan. 23, 2007

(54) METHOD AND APPARATUS FOR USING CONTINUOUS MEDIA STOCK IN A CUT-SHEET IMAGE FORMING DEVICE

(75) Inventors: Daniel P. Cahill, Verona, KY (US); Curtis D. Woodson, Georgetown, KY (US); David Anthony Schneider, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/874,707

(22) Filed: Jun. 23, 2004

(65) Prior Publication Data

US 2005/0286945 A1 Dec. 29, 2005

(51) Int. Cl.
*G03G 15/00* (2006.01)

(52) U.S. Cl. ..... 399/384; 399/385; 399/387; 399/394

(58) Field of Classification Search ..... 399/381, 399/324, 394, 384, 385, 386, 387
See application file for complete search history.

(56) References Cited

U.S. PATENT DOCUMENTS 4,763,161 A 8/1988 Forest et al.
4,929,982 A 5/1990 Ainoya et al.
5,295,616 A * 3/1994 Saeki et al. ..... 226/110
5,701,547 A 12/1997 Yamada et al.
5,810,494 A 9/1998 Menard et al.
5,920,743 A 7/1999 Yamada et al.
5,997,683 A 12/1999 Popat
6,165,304 A 12/2000 Otruba
6,330,424 B1 12/2001 Chapman et al.
6,633,740 B1 * 10/2003 Estabrooks ..... 399/384

* cited by examiner

*Primary Examiner*—Hoang Ngo
(74) *Attorney, Agent, or Firm*—Coats and Bennett, PLLC

(57) ABSTRACT

A device and method for applying images to continuous media stock, such as rolls of paper, blank labels, etc., using a cut-sheet image forming device. While the continuous media stock moves along a media path in the cut-sheet image forming device, one or more sensors in the cut-sheet image forming device detect inter-sheet holes disposed along the continuous media stock. Based on the detected inter-sheet holes, the cut-sheet image forming device tracks the position of the continuous media stock. By tracking the position of the continuous media stock, the cut-sheet image forming device can identify specific sections of the continuous media stock as image areas appropriate for image transfer.

19 Claims, 6 Drawing Sheets

METHOD AND APPARATUS FOR USING CONTINUOUS MEDIA STOCK IN A CUT-SHEET IMAGE FORMING DEVICE

BACKGROUND

The present invention relates generally to cut-sheet image forming devices and more particularly to using continuous media stock in cut-sheet devices.

Cut-sheet image forming devices, such as cut-sheet printers and copy machines, transfer images to cut-sheet media moving along a media path within the cut-sheet image forming device. While such devices are capable of transferring a wide variety of images to the cut-sheet media, these devices are limited to transferring images to the standard cut-sheet media currently available to the consumer, i.e., letter-sized media, legal-sized media, A4-sized media, envelopes, etc. As a result, consumers are obliged to buy an additional image forming device, such as a continuous media image forming device, to handle irregularly sized media stock and/or continuous media stock.

However, because purchasing and maintaining two separate image forming devices is expensive, many consumers would prefer a single image forming device capable of fulfilling both cut-sheet and continuous media functions. Further, developing a single device helps manufacturers of image forming devices to streamline their products, which saves money and, therefore, generates higher profit returns.

SUMMARY

The present invention is directed to a device and method for feeding continuous media stock through a cut-sheet image forming device. According to the present invention, an exemplary cut-sheet image forming device comprises a media path, a sensor, and a processor. The media path receives and moves continuous media stock through the cut-sheet image forming device. While the continuous media stock moves along the media path, the sensor detects inter-sheet holes disposed along the continuous media stock. Based on the detected inter-sheet holes, the processor tracks the position of the continuous media stock in the cut-sheet image forming device.

In an exemplary embodiment, the cut-sheet image forming device may identify specific sections of the continuous media stock by sensing the inter-sheet holes. For example, after sensing a first inter-sheet hole, the cut-sheet image forming device may identify the section following the first inter-sheet hole as a first section of the continuous media stock. Similarly, the section following a second sensed inter-sheet hole may be identified as a second section of the continuous media stock. In an exemplary embodiment, the cut-sheet image forming device may apply a specific image to each of the identified sections of the continuous media stock. For example, a first image may be applied to the first identified section, while a second image may be applied to the second identified section.

DETAILED DESCRIPTION

Figure 1:
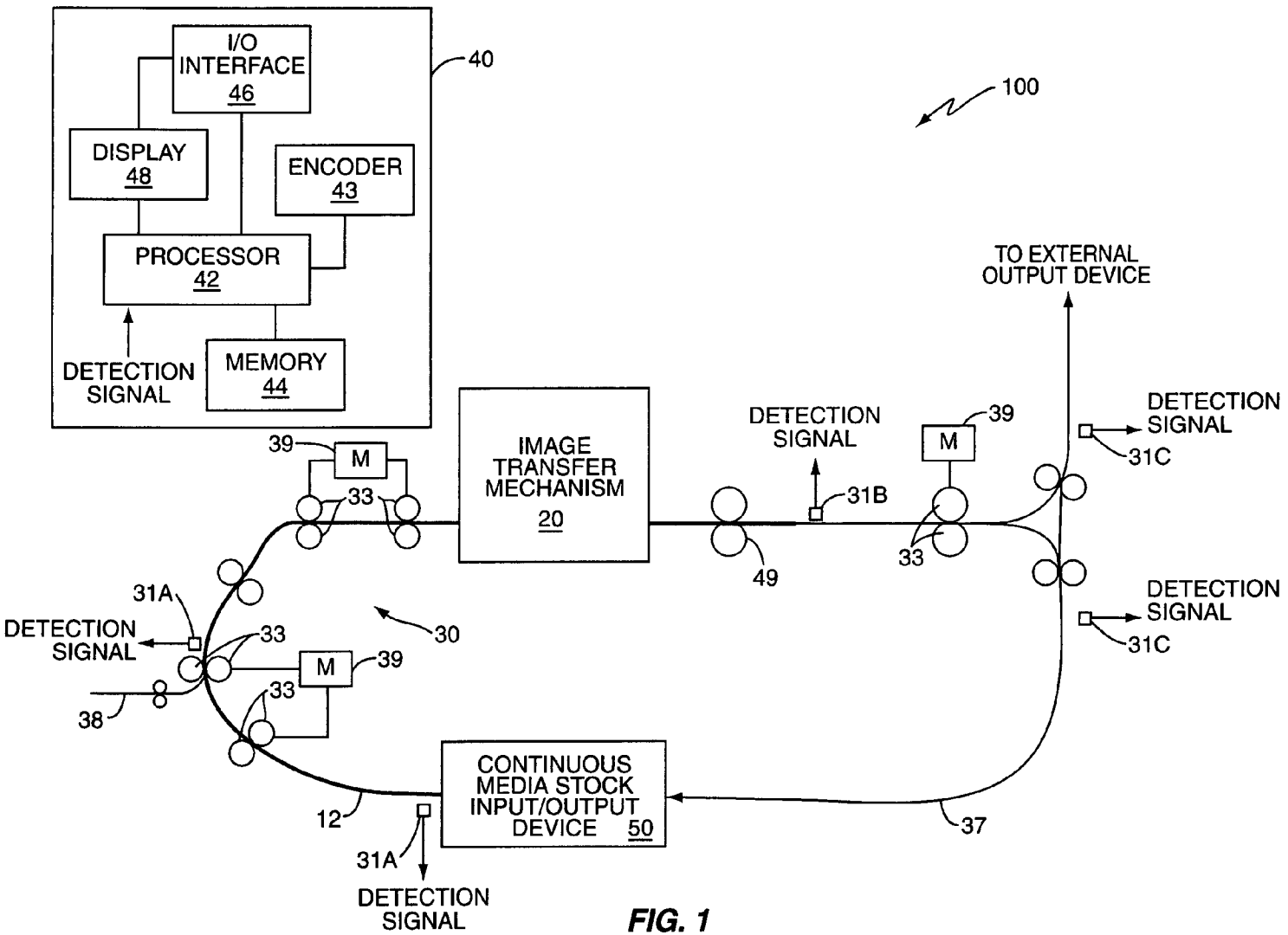
FIG. 1 illustrates a partial schematic side view of one embodiment of an image forming device according to the present invention.

The present invention is directed to a cut-sheet image forming device, generally represented by number 100 in FIG. 1, that automatically accepts both cut-sheet and continuous media stock. Cut-sheet image forming device 100 includes an image transfer mechanism 20, a media path 30, and processing electronics 40. Broadly, media stock 12, such as paper, transparencies, blank labels, etc., introduced to the media path 30 moves along the media path 30 as directed by the processing electronics 40. As shown in FIG. 1, media path 30 is formed by a series of single and/or multi-contact nip rolls 33 spaced a distance apart. The nip rolls 33 are spaced such that the media stock 12 remains in contact with at least one set of nip rolls 33. The nip rolls 33 may further be spaced such that the media stock 12 is simultaneously contacted by adjacent nip rolls 33. The amount of simultaneous contact may vary.

Nip rolls 33 include first and second drive rollers that are spaced such that a nip point is created between the two rollers. When media stock 12 passes through the nip rolls 33, the first and second drive rollers contact the top and bottom sides, respectively, of the media stock 12 to convey the media stock 12 along media path 30. Typically, one or more motors 39 rotate the drive rollers of nip rolls 33, where the processing electronics 40 control the speed and position of the media stock 12 as it moves along the media path 30 by controlling the speed of the motors 39. It will be appreciated by those skilled in the art that multiple motors 39 may be positioned along the media path 30 to control the speed of nip rolls 33.

In addition to controlling the nip roll motors 39, processing electronics 40 also oversee the overall image forming process of the cut-sheet image forming device 100. To that end, processing electronics 40 include a processor 42, memory 44, an input/output interface 46, and a display 48. Processor 42 implements instructions stored in memory 44 to control the motors and overall image forming process, as is well understood in the art. Input/output interface 46 operatively connects an input device (not shown) to the processor 42 to enable the operator to input data relevant to the image forming process. In one embodiment, the input is a keypad associated with the display 48. Display 48 may be operatively connected to the processor 42 for displaying information to the user. In an exemplary embodiment, display 48 includes a light emitting diode (LED) array or a liquid crystal display (LCD) to display alpha-numeric characters. In addition, according to the present invention, processor 42 implements instructions stored in memory 44 to define image sections and/or to transfer images to the media stock 12 based on received detection signals, as discussed further below.

In order to provide the detection signal to processor 42, cut-sheet image forming device 100 includes one or more sensors 31 disposed along media path 30 to detect and track the position of the media stock 12 on the media path 30. For example, sensors 31 may sense that the media stock 12 is properly positioned in the image transfer mechanism 20. When this happens, the sensors 31 send a detection signal to the processing electronics 40. Based on this detection signal, processing electronics 40 direct the image transfer mechanism 20 to transfer a desired image to the media stock 12 positioned in the image transfer mechanism 20.

In an exemplary embodiment, the image transfer mechanism 20 may transfer the image with an intermediate transfer mechanism, like the one used in Model Numbers C750 and C752, available from Lexmark International, Inc., of Lexington, Ky. An exemplary intermediate transfer mechanism comprises a plurality of toner cartridges each having a corresponding photoconductive drum. Each toner cartridge has a similar construction but is distinguished by the toner color contained therein. In one embodiment, the intermediate transfer mechanism includes a black cartridge, a magenta cartridge, a cyan cartridge, and a yellow cartridge. Generally, the different color toners form individual images in their respective color on their respective drums that are then combined in a layered fashion to create the final multicolored image.

More specifically, each photoconductive drum has a smooth surface for receiving an electrostatic charge from a laser assembly in the image transfer mechanism 20. The drums continuously and uniformly rotate past the laser assembly while the laser assembly directs a laser beam onto selected portions of the drum surfaces to form an electrostatic latent image representing the image to be transferred to the media stock 12. The drum is rotated as the laser beam is scanned across its length to form the entire image on the drum surface. After receiving the electrostatic latent image, the drums rotate past a toner cartridge, which has a toner bin for housing the toner and a developer roller for uniformly transferring toner to the drum. The toner is a fine powder usually composed of plastic granules that are attracted to the electrostatic latent image formed on the drum surfaces by the laser assembly.

After the latent image is formed on each drum surface, an intermediate transfer medium (ITM) belt receives the toner images from each drum surface. The ITM belt and drums are synchronized, enabling the toner image from each drum to precisely align in an overlapping arrangement. In one embodiment, a multi-color toner image is formed during a single pass of the ITM belt. In another embodiment, the ITM belt makes a plurality of passes by the drums to form the overlapping toner image.

Once the multi-color toner image is formed on the ITM belt, the ITM belt moves the toner image towards a second transfer point on the media path 30 to transfer the toner images to media stock 12. Typically, a pair of rolls forms a nip where the toner images are transferred from the ITM belt to the media stock 12. After the image is transferred to the media stock 12, the media stock 12 proceeds to a fuser 49, which adheres the toner to the media stock 12 according to conventional means.

In an alternate exemplary embodiment, image transfer mechanism 20 may comprise a direct transfer mechanism. Like the intermediate transfer mechanism described above, the direct transfer mechanism comprises a plurality of toner cartridges each having a corresponding photoconductive drum, where latent toner images are formed on each drum as described above. However, instead of the dual transfer method used by the intermediate transfer mechanism, the direct transfer mechanism has a single transfer as the image is transferred directly from the drum surfaces to the media stock 12. The media stock 12 is moved past each of the drums and the image is directly transferred to form the overlapping toner image. The media stock 12 with the overlapping toner image then proceeds to the fuser 49, which adheres toner to the media stock 12.

As discussed above, media path 30 includes one or more sensors 31 to track the position of the media stock 12 as it moves along media path 30. As shown in FIG. 1, an exemplary cut-sheet image forming device 100 may include input sensors 31A, fuser sensors 31B, and output sensors 31C. Input sensor 31A detects the media stock 12 as the media stock 12 enters the media path 30, fuser sensors 31B detect the media stock 12 as the media stock 12 leaves the fuser 49, and output sensors 31C detect that the media stock 12 is being output to an output device. The sensors 31 may detect a leading edge and/or trailing edge of the media stock 12.

Sensors 31 may be any type of sensor known in the art. For example, sensors 31 may comprise optical sensors that include an emitter that transmits a signal and a receiver that receives the signal. One embodiment includes a sensor 31 having a light-emitting diode as the emitter and a phototransistor as the receiver. Alternatively, sensors 31 may comprise mechanical sensors having a switching component that moves between a "media" position and a "gap" position based on the position of the media stock 12 relative to the sensor 31. In one embodiment, the media stock 12 may move the mechanical sensor to the "media' position when the media stock 12 is in line with the mechanical sensor. After media stock 12 passes the mechanical sensor, the mechanical sensor returns to the "gap" position. In any event, by tracking the position of the media stock 12, sensors 31 ensure that the image transfer mechanism 20 transfers the image to the correct position on the media stock 12.

In a conventional cut-sheet image forming device 100, sensors 31 track the position of the media stock 12 by detecting a leading edge of each individual sheet of the cut-sheet media stock as it moves along the media path 30. These sensors 31 work very well with conventional cut-sheet media stock, which typically has a maximum length of 14 inches. In one embodiment, an encoder 43 is operatively connected to the processing electronics 40 and ascertains the revolutions and rotational position of the motors 39. Each revolution of the motor 39 equates to a predetermined amount of movement of the media stock 12 along the media path 30. Tracking the revolutions of the motor 39 provides feedback for the processing electronics 40 to track the movement and location of media stock 12 along the media path 30.

Processing electronics 40 registers the position at the time a leading edge or trailing edge of the media stock 12 passes through a sensor 31. Subsequent positions are calculated by monitoring the feedback from the encoder 43 to determine the distance the stock 12 has moved since being detected by the sensor 31. By way of example, at some designated time, a leading edge of the media stock 12 is input into the device 100 and eventually trips an input media path sensor 31A. Processing electronics 40 begins tracking incrementally the position of the stock 12 by monitoring the feedback of encoder 43 associated with the motor 39. The position of the stock 12 is tracked in this manner until the media stock 12 moves through another sensor 31. In the embodiment of FIG. 1, this occurs when the media stock 12 moves through the fuser 49 and is detected by sensor 31B. The position of the media stock 12 continues to be tracked in this manner with the location detected by the sensors 31, and incremental positions tracked by monitoring the motors 39 and encoders 43. In another embodiment, the incremental location is determined by monitoring the number of steps taken by the motor 39 since the media stock 12 has last moved through a sensor 31. One embodiment of the movement of the media stock 12 along the media path 30, and the monitoring of the location of the media stock 12 is disclosed in U.S. Pat. No. 6,330,424, assigned to Lexmark International, Inc., and herein incorporated by reference in its entirety.

Figure 2:
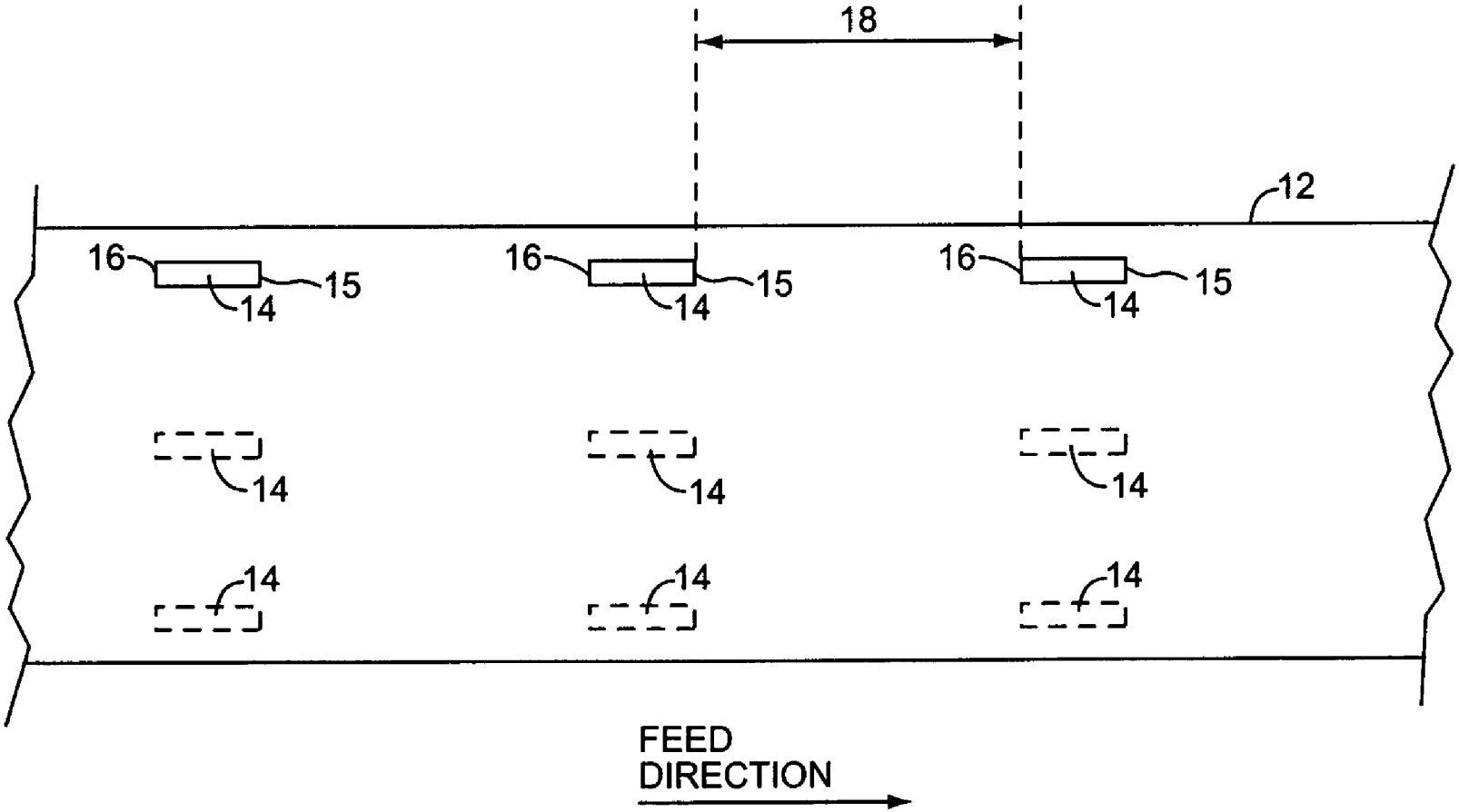
FIG. 2 illustrates a top view of exemplary continuous media stock moving along the media path.

However, because continuous media stock 12 is made up of a continuous sheet of media stock 12 that is significantly longer than 14 inches, and because continuous media stock 12 only has one leading edge, conventional cut-sheet image forming devices are ill-equipped to handle continuous media stock 12. Inter-sheet holes 14 disposed along the continuous media stock 12, as shown in FIG. 2, are used by the processing electronics 40 to monitor the position of the stock 12. As discussed further below, these inter-sheet holes 14 form artificial gaps in the continuous media stock 12 to actuate the sensor 31 at the correct timing interval so that the processing electronics 40 detects the leading edge of a new page.

As illustrated in FIG. 2, the inter-sheet holes 14 are positioned along the length of the continuous media stock 12 and are detected by one or more sensors 31 as the media stock 12 moves along the media path 30. As a result, the inter-sheet holes 14 define individual sections or image areas 18 in the continuous media stock 12.

As shown in FIG. 2, each inter-sheet hole 14 includes a leading edge 16 and a trailing edge 15. The leading edge 16 represents the beginning of a specific section 18 of the continuous media stock 12, while the trailing edge 15 represents the end of the section 18. To track the continuous media stock 12, processing electronics 40 tracks the position of the inter-sheet holes 14 as the media stock 12 moves along the media path 30. More specifically, each time a sensor 31 detects a leading edge 16 of an inter-sheet hole 14, the processing electronics 40 operate as if a new page of a cut-sheet media stock has been detected by the sensors 31. For example, after the continuous media stock 12 is introduced to the media path 30, input sensor 31A detects the leading edge of the continuous media stock 12 and provides an input detection signal to the processing electronics 40. As the continuous media stock 12 moves along the media path 30, input sensor 31A detects a leading edge 16 of the first inter-sheet hole 14. Based on the detected leading edge 16, the processing electronics 40 determine that a new section 18 of the continuous media stock 12 has entered the media path 30. As the continuous media stock 12 continues to move along the media path 30, the leading edges 16 of subsequent inter-sheet holes 14 are detected by input sensor 31A, signaling to the processing electronics 40 that a new section has entered media path 30. As a result, the processing electronics 40 can accurately time the image transfer process to transfer images to the appropriate sections 18 of the continuous media stock 12. Further, the processing electronics 40 can track the position of the individual new sections 18 as the continuous media stock 12 feeds through the device 100.

As shown in FIG. 2, the inter-sheet holes 14 are longitudinally spaced along the length of the continuous media stock 12 by a predetermined distance to define the desired image areas 18 on the continuous media stock 12. It will be appreciated by those skilled in the art that this separation distance may be any standard or non-standard separation distance. It will also be appreciated that inter-sheet holes 14 may be any desired length. In exemplary embodiments, the length of the inter-sheet holes 14 corresponds to a desired gap between the image areas of the continuous media stock 12. Further, while FIG. 2 illustrates inter-sheet holes 14 that are uniformly spaced along the continuous media stock 12, those skilled in the art will appreciate that any desired spacing, uniform or uneven, may be implemented. When uneven spacing is used, processing electronics 40 may direct sensors 31 to detect both the leading edges 16 and the trailing edges 15 of the inter-sheet holes 14 so that the size of the image area 18 may be identified by the processing electronics 40. Alternatively, a user may specify the specific spacing of each section of continuous media stock 12. Further, a user may specify other characteristics of the continuous media stock 12, such as media type, a desired gap length, a desired inter-sheet hole separation, etc. In any event, by sensing the inter-sheet holes 14 in the media stock 12, the cut-sheet image forming device 100 of the present invention separates the continuous media stock 12 into multiple image sections 18, which enables the cut-sheet image forming device 100 to apply multiple images to continuous media stock 12. According to the present invention, the cut-sheet image forming device 100 may apply the same image to each section 18 of the continuous media stock 12. Alternatively, the cut-sheet image forming device 100 may apply different images to each section 18.

Turning back to FIG. 1, conventional cut-sheet image forming devices include various means for introducing media stock 12, i.e., paper, transparency material, label material, etc., into the media path 30. According to one method, cut-sheet media stock may be manually loaded into a multi-purpose feeder 38, as is well understood in the art. Alternatively, an input tray in an input/output device within the cut-sheet image forming device 100 may hold a stack of media stock 12, where a pick mechanism picks a topmost sheet from the stack and feeds it towards the first nip rolls 33, as is well understood in the art.

However, to facilitate the introduction of the continuous media stock 12, such as continuous paper, transparency material, label material, etc., to media path 30, the cut-sheet image forming device 100 may be modified to provide means for introducing continuous media stock 12 into the media path 30. To that end, cut-sheet image forming device 100 may include a continuous media stock input/output device 50. Continuous media stock input/output device 50 may supplement or replace the conventional input tray used by conventional cut-sheet image forming devices.

Figure 3A:
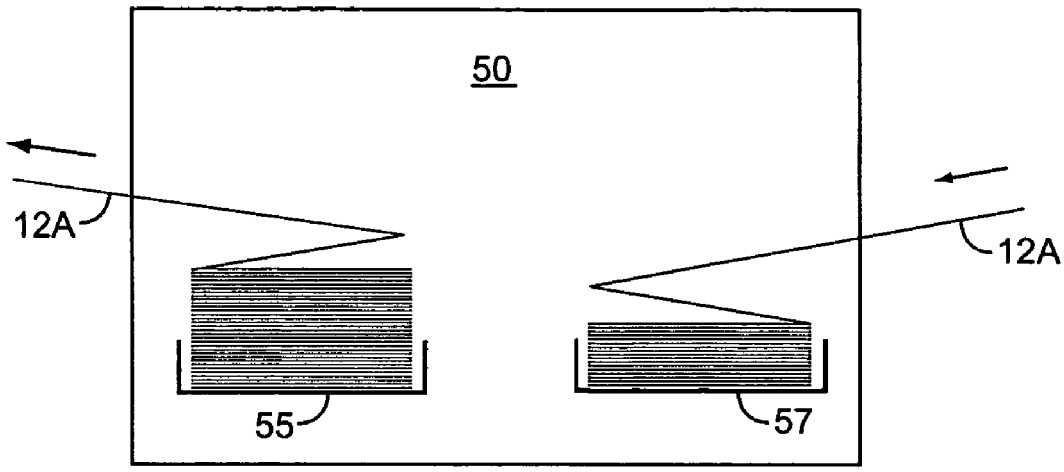
FIGS. 3A and 3B illustrate exemplary input/output devices for the image forming device of FIG. 1.
Figure 3B:
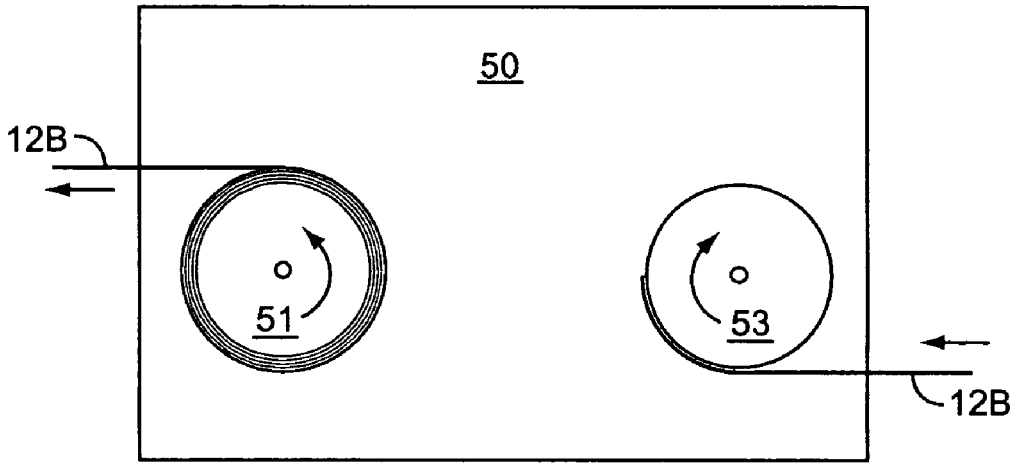

FIGS. 3A and 3B illustrate exemplary continuous media stock input/output devices 50 for the cut-sheet image forming device 100 of FIG. 1. In the embodiment of FIG. 3A, the continuous media stock is in a fan-folded format and the input/output device 50 may include an input tray 55 that holds a supply stack of continuous media stock 12A. The stack of continuous media stock 12A may be supplied from the input tray 55 by any means known in the art. For example, the pick mechanism mentioned above may be used to continuously feed the stack of continuous media stock 12A to the media path 30. Alternatively, as shown in FIG. 3B, continuous media stock is in a roll form and input/output device 50 may include a supply spool 51 that holds a supply roll of continuous media stock 12B and feeds the supply roll of continuous media stock 12B to the media path 30 by any known means. For example, a motor (not shown) may rotate the supply spool 51 to dispense the roll of continuous media stock 12B from supply spool 51 to the media path 30.

While not required, continuous media stock input/output device 50 may also include an output device for storing continuous media stock 12 that has exited media path 30. For example, when the continuous media stock 12 comprise a stack of continuous media stock 12A, as shown in FIG. 3A, the output device may comprise an output tray 57 for stacking the continuous media stock 12A as it exits the media path 30. Alternatively, when the continuous media stock 12 comprises a roll of continuous media stock 12B, as shown in FIG. 3B, the output device may comprise an output spool 53 for storing the roll of continuous media stock 12B as it exits the media path 30.

It will also be appreciated that media path 30 may alternatively route the continuous media stock 12 to an external output device. An exemplary external output device may comprise an external output tray or spool similar to those shown in FIGS. 3A and 3B. Alternatively, the media path may route the continuous media stock 12 to an external processing system (not shown) that further processes the continuous media stock 12. For example, if the cut-sheet image forming device 100 applies images to labels disposed on the continuous media stock 12, the media path may route the newly printed labels disposed on continuous media stock 12 to an external processing system to apply the labels to desired surfaces.

Figure 4:
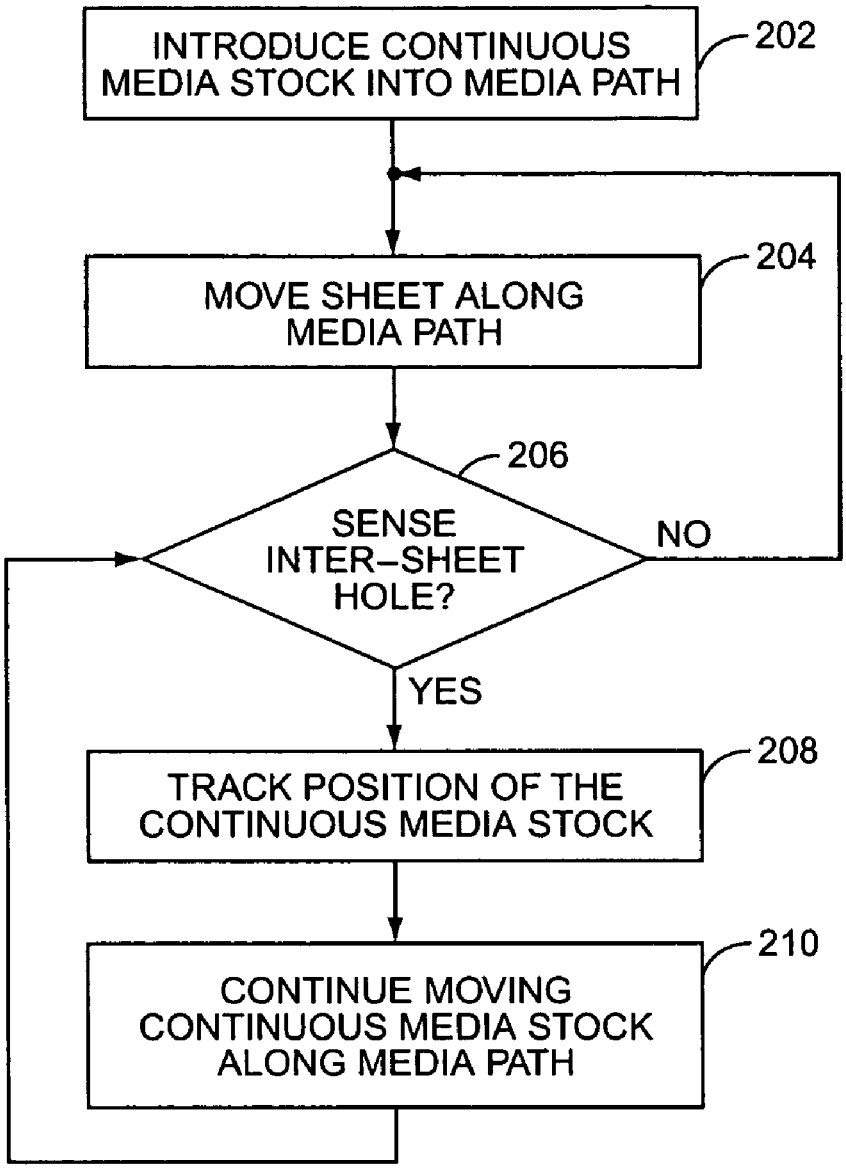
FIG. 4 illustrates an exemplary flow diagram of the steps for tracking the position of the continuous media stock as it moves along the media path.
Figure 5:
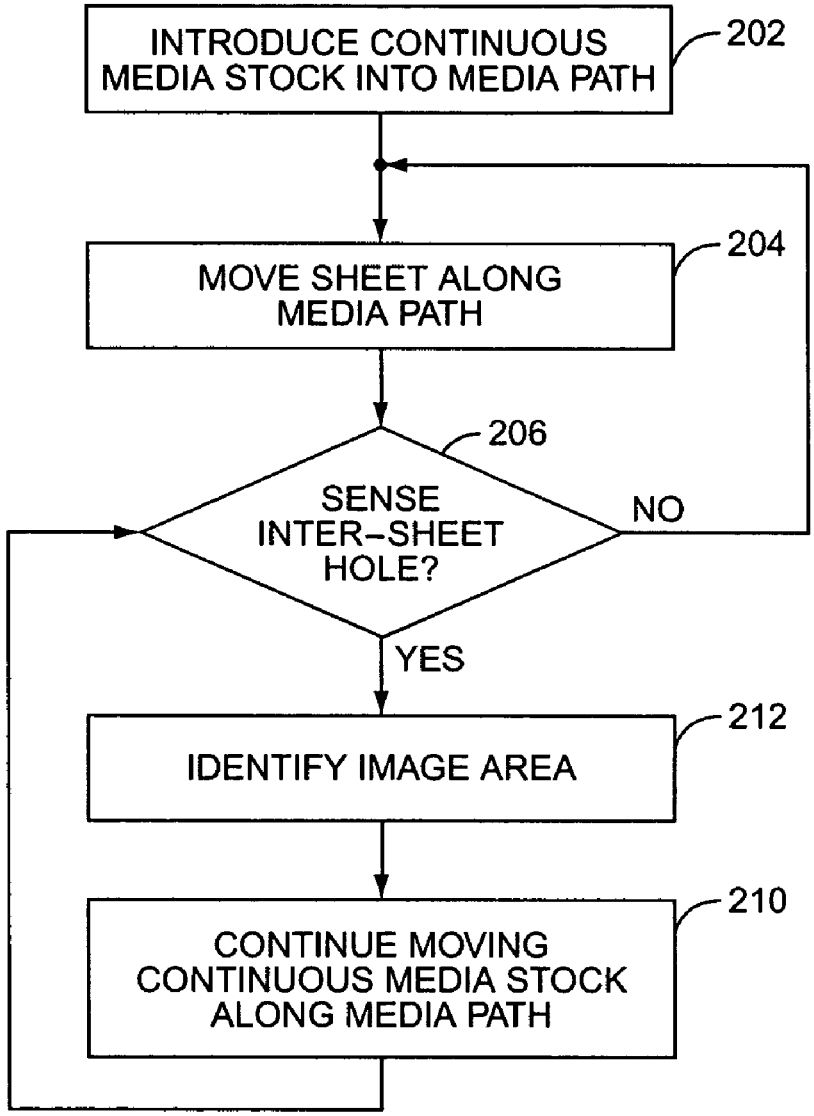
FIG. 5 illustrates an exemplary flow diagram of the steps for identifying image areas on the continuous media stock as it moves along the media path.
Figure 6:
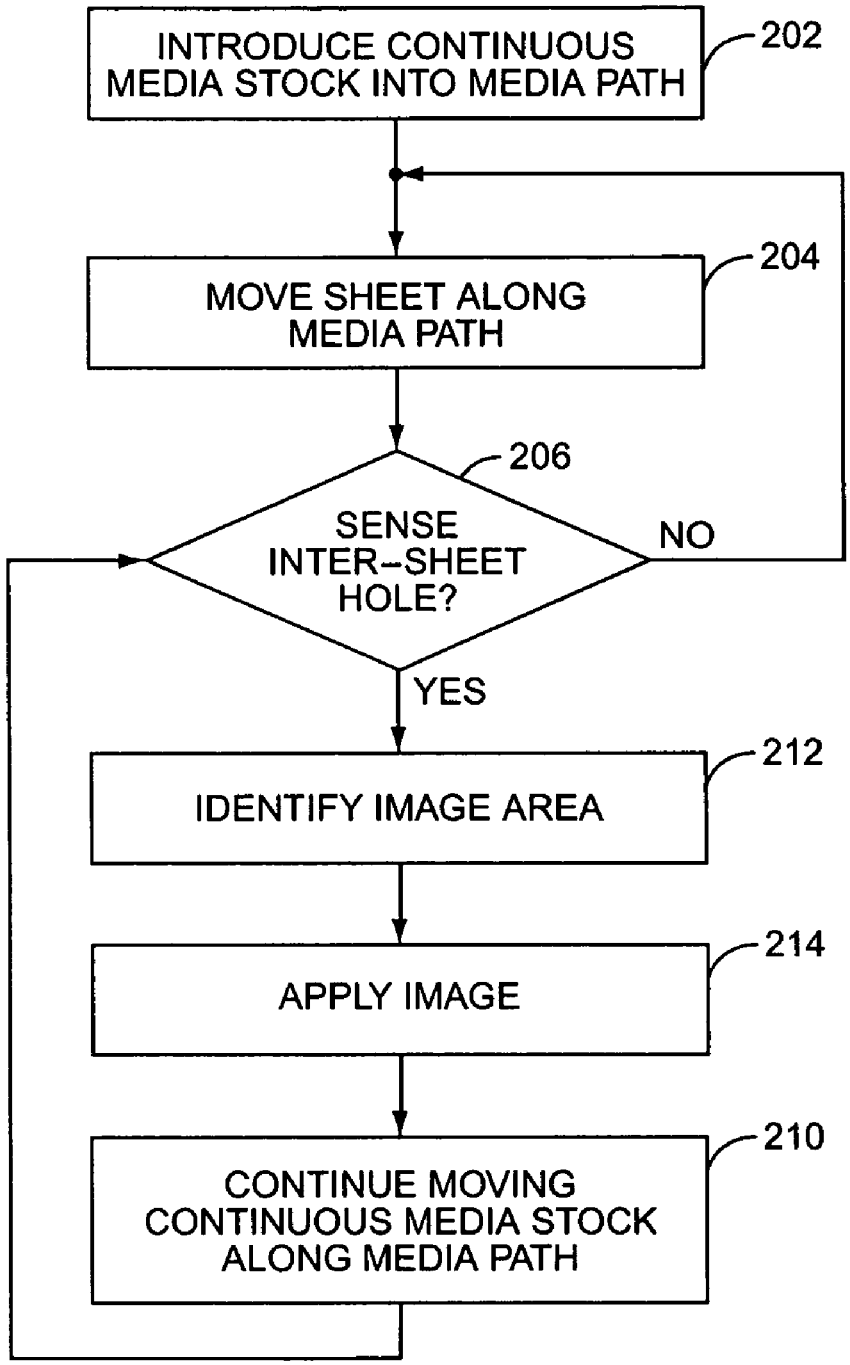
FIG. 6 illustrates an exemplary flow diagram of the steps for applying an image to the continuous media stock as it moves along the media path.

Turning now to FIGS. 4–6, exemplary processes for implementing the present invention will be described. Generally, the present invention is a method of tracking the position of continuous media stock 12 along a media path 30 of a cut-sheet image forming device 100, as shown in FIG. 4. After the continuous media stock 12 is introduced into the media path (step 202), the nip rolls 33 move the continuous media stock 12 along the media path 30 (step 204) as described above. When the sensors 31 detect an inter-sheet hole 14 (step 206), a detection signal is sent to the processing electronics 40 to enable the processing electronics 40 to track the position of the continuous media stock 12 (step 208). The continuous media stock 12 continues moving along the media path (step 210) and the process repeats.

More specifically, an exemplary embodiment of the present invention tracks the position of the continuous media stock 12 along the media path 30 to identify image areas 18 on the continuous media stock 12, as shown in FIG. 5. When sensors 31 detect an inter-sheet hole 14 (step 206), processing electronics 40 identify an image area 18 (step 212) based on the position of the detected inter-sheet hole 14. In some embodiments, the image area 18 may be defined as the area following the leading edge 16 of an inter-sheet hole 14. In other embodiments, the image area 18 is the area between the leading edge 16 of an inter-sheet hole 14 and the trailing edge 15 of a subsequent inter-sheet hole 14. In any event, once the processing electronics 40 identify the image area 18 (step 212), the processing electronics 40 direct the image transfer mechanism 20 to transfer an image to the image area 18 (step 214), as shown in FIG. 6. The process (steps 202–214) repeats until all desired images have been transferred to the continuous media stock 12 or until all of the continuous media stock 12 passes through the cut-sheet image forming device 100.

Holes 14 may be positioned at a variety of locations along the width of the continuous media stock 12. In the embodiment illustrated in FIG. 2, the holes 14 are positioned entirely within the media stock 12. Holes 14 in solid lines are adjacent to a first edge, as other hole embodiments are illustrated in dashed lines positioned further from the first edge. In another embodiment (not illustrated), holes 14 are positioned along an edge and are not entirely contained within the media stock 12. Further, the media stock 12 may contain more than one set of holes 14. In one embodiment, a first set of holes 14 are detected by a first sensor 31, and a second set are detected by a second sensor 31. The shapes of the holes 14 may also vary depending upon the application.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of feeding continuous media stock through a cut-sheet image forming device comprising:

introducing the continuous media stock into the cut-sheet image forming device, wherein one or more inter-sheet holes are disposed along the continuous media stock; and tracking the position of the continuous media stock in the cut-sheet image forming device by sensing the inter-sheet holes as the continuous media stock moves through the cut-sheet image forming device; and applying images to the media stock while the media stock is in a continuous format as it moves through the image forming device based on the position of the one or more inter-sheet holes.

2. The method of claim 1 wherein sensing each of the inter-sheet holes comprises sensing a leading edge of each inter-sheet hole.

3. The method of claim 2 wherein sensing each of the inter-sheet holes further comprises sensing a trailing edge of each inter-sheet hole.

4. The method of claim 1 wherein introducing the continuous media stock into the cut-sheet image forming device comprises introducing the continuous media stock into a cut-sheet printer.

5. A cut-sheet image forming device for applying images to continuous media stock comprising:

a media path to receive and move the continuous media stock along the cut-sheet image forming device;

a sensor to detect inter-sheet holes disposed along the continuous media stock as the continuous media stock moves along the media path and detect a position of the continuous media stock; and a processor to track the position of the continuous media stock based on the position of the detected inter-sheet holes.

6. The cut-sheet image forming device of claim 5 wherein the sensor detects a leading edge of an inter-sheet hole and wherein the processor identifies a section following the detected leading edge of the inter-sheet hole as an image section of the continuous media stock.

7. The cut-sheet image forming device of claim 6 wherein the sensor detects a trailing edge of a subsequent inter-sheet hole and wherein the processor further identifies the image section as the section between the detected leading edge of the inter-sheet hole and the trailing edge of the subsequent inter-sheet hole.

8. A method of applying multiple images to a continuous media stock moving along a media path of a cut-sheet image forming device, the method comprising:

sensing a first inter-sheet hole disposed in the continuous media stock;

applying a first image to a section of the continuous media stock following the first inter-sheet hole while the media stock is in a continuous format;

sensing a second inter-sheet hole disposed in the continuous media stock; and applying a second image to a section of the continuous media stock following the second inter-sheet hole while the media stock is in a continuous format.

9. The method of claim 8 wherein sensing the first inter-sheet hole comprises sensing at least one of a leading edge and a trailing edge of the first inter-sheet hole.

10. The method of claim 9 wherein sensing the second inter-sheet hole comprises sensing at least one of a leading edge and a trailing edge of the second inter-sheet holes.

11. A method of tracking the position of a continuous media stock moving through a cut-sheet image forming device comprising:

introducing the continuous media stock into the cut-sheet image forming device, wherein one or more inter-sheet holes are disposed along the continuous media stock;

sensing a first inter-sheet hole as the continuous media stock moves through the cut-sheet sheet image forming device;

identifying a first section of the continuous media stock as the section following the first inter-sheet hole;

applying an image to the first section while the media stock moves through the cut-sheet image forming device in a continuous format;

sensing a second inter-sheet hole as the continuous media stock moves through the cut-sheet image forming device; and identifying a second section of the continuous media stock as the section following the second inter-sheet hole.

12. The method of claim 11 further comprising applying a second image to the second section of the continuous media stock.

13. A method of using an image forming device comprising the steps of:

inputting a cut sheet into the image forming device;

sensing a leading edge of the cut sheet;

forming a first toner image at a location on the cut sheet based on the leading edge;

inputting a continuous media stock into the image forming device;

sensing a hole in the continuous media stock; and forming a second toner image on the continuous media stock at a position based on the hole.

14. The method of claim 13 further comprising sensing a second hole in the continuous media stock and forming a third toner image on the continuous media stock based on a sensed location of the second hole.

15. The method of claim 14 further comprising inserting a second cut sheet into the image forming device after the continuous media stock and forming a fourth toner image on the second cut sheet based the second cut sheet leading edge.

16. A method of forming images with an image forming device comprising the steps of:

feeding a continuous media stock into the image forming device;

detecting a hole in the continuous media stock and identifying a first image area;

forming a first toner image at the first image area;

detecting a second hole in the continuous media stock and identifying a second image area;

forming a second toner image at the second image area;

feeding the continuous media stock through the image forming device;

feeding a cut sheet into the image forming device;

sensing a leading edge of the cut sheet; and forming a third toner image one the cut sheet at a location based on the leading edge.

17. The method of claim 16, further comprising monitoring a location of the first image area as the continuous media stock moves through the image forming device.

18. The method of claim 17, further comprising monitoring the second image area as the continuous media stock moves through the image forming device.

19. The method of claim 16, further comprising forming a duplex image on a second side of the cut sheet.

* * * * *